United States Patent [19]

Laycock et al.

[11] 4,045,986

[45] Sept. 6, 1977

[54] FORMING DUCTILE MATERIALS

[75] Inventors: David Brian Laycock, Cambridge; Anthony John Barnes, Malvern, both of England

[73] Assignee: T.I. Superform, Worcester, England

[21] Appl. No.: 673,859

[22] Filed: Apr. 5, 1976

[51] Int. Cl.[2] ..... B21D 22/10

[52] U.S. Cl. ..... 72/60; 29/421 R

[58] Field of Search ..... 72/60, 63, 421, DIG. 31, 72/62, 56, 58, 59; 29/421

[56] References Cited

U.S. PATENT DOCUMENTS

| | | | |
|---|---|---|---|
| 2,292,462 | 8/1942 | Milford | 72/60 |
| 2,344,743 | 3/1944 | Smith | 72/63 |
| 2,410,857 | 11/1946 | Ahern | 72/60 X |
| 2,728,317 | 12/1955 | Clevenger et al. | 72/60 |
| 3,529,458 | 9/1970 | Butler et al. | 72/60 |

*Primary Examiner*—Leon Gilden

*Attorney, Agent, or Firm*—Scrivener, Parker, Scrivener and Clarke

[57] ABSTRACT

In the shaping of ductile metal sheet, especially superplastic alloy sheet, by the application of pressure differentials, the peripherally clamped sheet is first urged, by pressure differential in one direction, against a female molding surface to form a partially shaped bubblelike preform and then a male mold is advanced towards the sheet from the other side and a reverse pressure differential is applied to cause the pre-form to conform to the shape of that mold. The active area forming the preform may be restricted by an apertured plate adjacent the clamping plane, matching the overall outline of the body, and a plate the other side matching closely the profile of the body may confine the action of the reverse pressure only to that part of the sheet that engages the progressively increasing part of the male mold that extends through the clamping plane so that the sheet locks progressively onto the sides of the male mold to obtain an approximately uniform wall thickness in the finished body.

13 Claims, 12 Drawing Figures

FORMING DUCTILE MATERIALS

This invention relates to the forming of ductile sheet metals into bodies of various shapes. It is primarily applicable to forming those materials known as superplastic alloys, which have a high ductility and also a low flow stress, although it may be applied also to normal materials which can be rendered sufficiently easy to stretch at elevated temperatures, for example some conventional aluminium alloys.

The simple process of vacuum-forming (or otherwise forming by differential pressure) into a female mould is adequate for smoothly rounded shapes that are not too deep, but tends to result in products with appreciable variations in thickness. Forming onto a male mould, either by vacuum or other differential pressure techniques, or by advancing a male member into a peripherally clamped flat sheet or bubble, in general allows deeper shapes to be reproduced with acceptable uniformity of thickness but there is a limit to the depth of the body that can be formed without wastage of material because the blank needs to be considerably larger than the projected area of the body, and where sharp corners and angular shapes are involved it is difficult to avoid puckering and excessive thinning of the metal locally in some regions as compared to others.

The aim of the invention is to provide a method of deforming an initially flat, peripherally clamped, sheet of superplastic or other ductile sheet metal which will allow the production of relatively deep and complex shapes, in particular asymmetrical shapes, while keeping to a minimum the faults mentioned above, and also without excessive waste of material.

According to the invention there is proposed a method of forming a shaped body from a sheet of ductile metal comprising clamping the periphery of the sheet in a given plane, applying a differential pressure across it to force it into at least partial contact with a moulding surface or surfaces lying on that side of the sheet which is then at the lower pressure, the sheet being thereby partially shaped, advancing a male mould towards the opposite side of the sheet to project at least partially through the clamping plane, and reversing the pressure conditions to cause the sheet to come into engagement with that mound, and eventually take up the contours of that mould.

For example the mould surface or surfaces, which we can term the pre-form mould, may be a single surface of female form and have a relatively simple shape. It is preferably retracted and the pressure difference reduced to zero before the pressure in the opposite direction is applied and the male mould is preferably advanced into and beyond the clamping plane before application of the reverse pressure.

The advance of the male mould is preferably such that it engages the sheet and causes deformation and redistribution of the material of the sheet to a significant extent before the reverse pressure is applied; the advance then continues, but possible at a lower rate. Alternatively the reverse pressure may be applied just before the male mould engages the sheet.

The process is particularly suitable for bodies of rectangular shape, or of an asymmetrical nature. The preform mould into which the sheet is first urged has a profile such as to give the pre-form a shape which goes part of the way towards the final shape. Instead of being a female mould, the first moulding surfaces could simply comprise a flat surface against which the sheet is urged, possibly with the assistance of lateral guide surfaces, and may even have male projections to assist in shaping the pre-form.

Because of the initial step of creating a pre-form that is already stretched, the final shape can follow, better than was hitherto possible, the contours of the mould without excessive localised thickness variations.

Moreover the first moulding surface may itself be advanced towards the pre-form during the first application of differential pressure so as to squash the pre-form to some extent. The natural tendency of the bubble-like pre-form is to have a wall thickness which is greater near the clamping plane and smaller over its dome or peak, and the contact with the first moulding surface helps to counteract this.

To avoid puckering or wrinkling, especially in the shaping of a body having, in plan view, projecting corners, for example a rectangular shape, it is important that the sheet should be restrained by the clamping means, or by a separate plate, which we may term a 'bubble plate', to define a restricted active area that forms the initial bubble or pre-form, this active area having an outline that barely clears the outline of the body to be formed.

According to a further feature of the invention the blank is also clamped or restrained on the other side around a line which is close to the perimeter of the male member (in contrast to known arrangements where the cross-section of the male member is much less than the clamped periphery) and so as the male mould advances through the clamping plane a progressively increasing area is exposed to the reversed pressure differential and, as the sheet is stretched by the advance of the male mould, the thin parts of the sheet are progressively locked against the side surfaces of the male mould, restricting further thinning in those regions.

The restraints mentioned above may be provided by giving the opening in the clamping plate on the opposite side from the bubble plate an outline conforming to, but slightly larger than, the cross-section of the male mould, or there could be a stationary backing plate, as well as a stationary bubble plate, both separate from the clamping plates, so that for different jobs each male mould has associated matching backing and bubble plates, whilst the clamping plates can remain undisturbed and have openings of a standard shape.

Where we have spoken of the male mould being advanced towards the sheet it will be understood that this is a relative movement, and that we intend also that this phrase should cover the possibility that the male mould could remain stationary and the sheet be moved relative to it.

The pressure which is applied at the different stages need not have a fixed value but can be varied progressively during the cycle. Likewise, the rate of movement of the mould, where the or each mould is movable, can be varied in the course of the cycle; by inter-relating the variation in pressure differential and the movement of the mould or moulds one can control the points in the sheet at which the sheet is engaged by the mould. For example, in the case of the male mould, one can advance the mould into the concave side of the bulged sheet and at the appropriate instant apply the pressure differential across the sheet so that the sheet is forced against the mould. Depending on the instant chosen and the pressure applied, the area of sheet that locks onto the end region of the mould will be greater or smaller and the degree of stretching of the sheet to fit around the sides of the mould will vary accordingly.

The invention will now be further described by way of example with reference to the accompanying drawings, in which.

Figure 1:
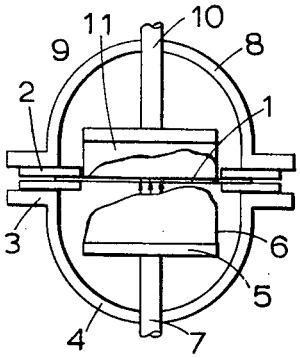
FIGS. 1 to 5 show successive stages in the formation of a shaped body in the manner according to the invention, FIG. 6 show diagrammatically to a larger scale a modified form of apparatus for achieving the same result.

Referring first to FIG. 1, a sheet 1 of a superplastic metal alloy is clamped between two apertured clamping plates 2 and 3. The plate 3 has secured to it a pot-shaped housing 4 which defines, with the sheet 1, a closed cavity. Within this cavity is a table 5 designed to receive releasably a male mould 6 which has the shape which the article, to be made from the sheet 1, is finally to acquire. The table 5 is movable in a direction perpendicular to the plane of the sheet 1 by means of a rod 7 passing through a seal in the wall of the housing 4, and actuated, for example, pneumatically or hydraulically.

A second housing 8, similar to the housing 4, is sealed to the clamping plate 2 to define a second cavity on the opposite side of the sheet 1 from the mould 6. In this second cavity is a table 9 movable on a rod 10 in a direction perpendicular to the plane of the sheet 1; in fact the rods 7 and 10 can be coaxial. the table 9 carries a female mould 11 which we will call the pre-form mould and which has a concave shape which does not correspond to the final shape of the article but to that of an intermediate pre-form or parison, which is designed to result in an initial deformation of the sheet that is designed to correct as far as possible, in advance, any faults or distortions that would otherwise arise in the final shaping of the sheet to the profile of the mould 6.

Figure 2:
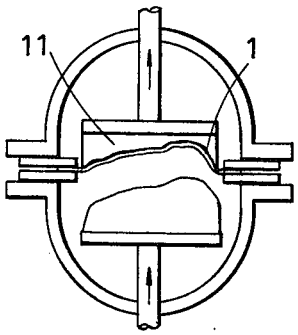

Starting from the position shown in FIG. 1, a pressure differential is applied across the sheet 1 by the admission of a fluid (preferably air) at above atmospheric pressure, to the housing 4, forcing the sheet into contact with the pre-form mould 11. This is the position illustrated in FIG. 2. On completion of this step the pressure differential is removed. The table 9 is then retracted and at the same time the table 5 is advanced, as indicated by the arrows in FIG. 2, to bring the other mould 6 towards the sheet 1, the mould thus at least partially projecting through the plane in which the sheet is clamped.

Preferably the male mould 6 engages the partly shaped sheet over a substantial area, or at least along lines rather than at one more individual points, and its continues to advance and deform the sheet, redistributing the material of the sheet to a significant extent, in particular urging it towards the regions that are to form the more remote corners of the final body, all this taking place before reversal of the pressure.

Figure 3:
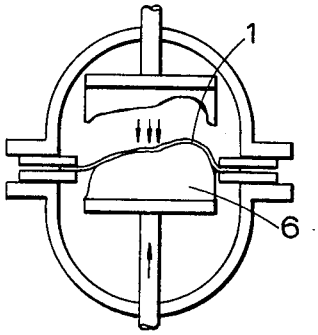
Figure 4:
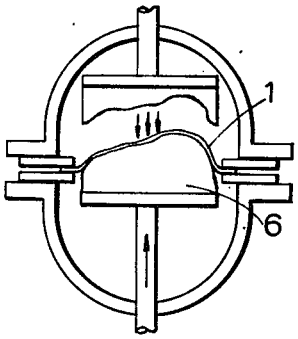
Figure 5:
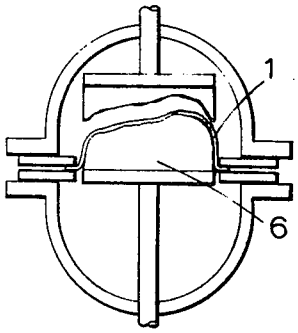

A pressure differential is then applied across the sheet 1 in the opposite direction from that previously applied (for example by exhausting the housing 4 and admitting air under pressure to the housing 8) to bring the sheet into intimate contact with the mould 6, shaping the sheet to the profile of that mould, as indicated in FIG. 3. In the meantime the advance of the mould 6 is continuing. The magnitude of the pressure and the rate of advance of the male mould can be inter-related and individually programmed to achieve the desired degree of stretching of the sheet as it follows the contours of the mould 6. The progress towards the final shape is shown in FIGS. 4 and 5.

It will be noted that the sheet does not have to undergo any overall reversal of its initial convex or concave shape on application of the reverse pressure, On the contrary, the initial shape created by the pre-form mould is simply further developed and enhanced by the final mould.

The clamping plates 2 and 3 in the example illustrated have apertures in them which conform to the shapes of the largest cross-sections of the moulds 11 and 6 respectively, with a sufficient clearance to allow for the thickness of the sheet. In a practical version the functions of clamping and of defining the shapes of the apertures may be performed by separate components, making it easier to change the aperture plates when a change of mould is required. This is explained below with reference to FIGS. 11 and 12. Also the inner edges of the aperture plates may be shaped, for example by the incorporation of axially extending lips or flanges, to assist the sheet in conforming to the shape of the moulds as described below with reference to FIG. 6.

Figure 6:
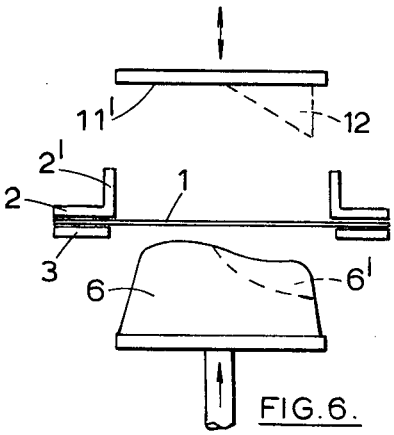

FIG. 6 shows a version in which there is no single complete female mould for shaping the pre-form. Instead there is a flat surface 11' against which the sheet 1 is bulged by the pressure differential. As the dome-shaped bubble formed from the sheet engages this surface its central portion is flattened so the continued action of the pressure is to cause it to spread laterally. Friction between the surface 11' and the region of the sheet that is in contact with it restrains the further stretching of this region, preventing it from becoming excessively thin, whilst the portions not yet in contact with the surface 11' continue to stretch, thereby obtaining a more uniform overall thickness for the pre-form than could be obtained simply by forming a bubble.

At the end of this step the pressure differential is reduced to zero.

Excessive lateral spreading is prevented by a guide flange 2' which, in the example shown, is formed integrally on the inner edge of the clamping plate 2, although it is generally preferably a separate component.

FIG. 6 also shows in broken lines at 12 how the surface 11' may even carry one or more local projections that will indent the surface of the sheet to cause local re-entrant regions. Such projections may also be provided in the female mould of FIGS. 1 to 5. Then when the male mould is advanced and the reverse pressure differential is applied, as in the version of FIGS. 1 to 5, these re-entrant portions are already partially of the right shape to fill recesses such as 6' in the male mould accurately, and as far as possible without puckering, creasing or rupture. In this way relatively complex shapes can be produced, including one or more re-entrant regions, a result that was not obtainable by the known methods simply employing a single mould onto which the sheet was forced. In such known methods the sheet would simply bridge the recess and when the pressure was applied it was liable to puckering or, more seriously, excessive thinning and possible rupture.

Figure 7:
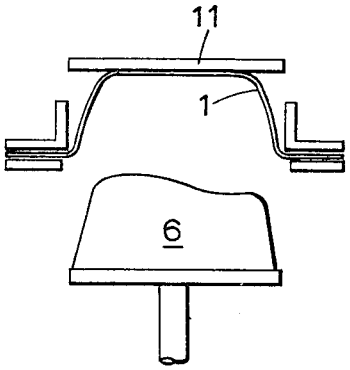
FIGS. 7,8,9 and 10 show successive stages in the formation a body in the apparatus of FIG. 6.
Figure 8:
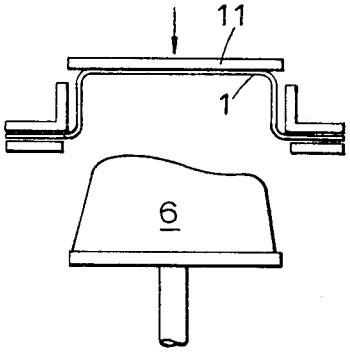

In the embodiment of FIG. 6 the surface 11' may remain stationary throughout. Preferably, however, after being engaged by the bubble as shown in FIG. 7, it is advanced, as shown in FIG. 8, to cause further the formation in the pre-forming step and then retracted to allow the tip of the male mould 6 to advance beyond the original plane of the surface 11'.

Figure 9:
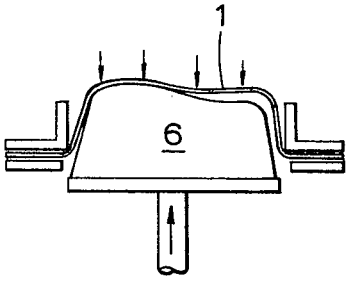
Figure 10:
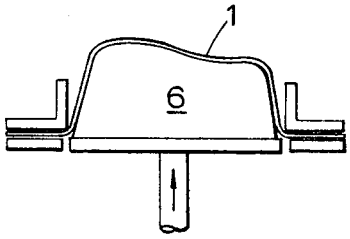

In FIG. 9 the male mould 6 has advanced through the clamping plane and has engaged the pre-form, starting to deform it. Thereupon, the reverse pressure differential is applied and the sheet is forced into intimate contact with the male mould, which continues to advance (the surface 11 meanwhile having retracted) to a final position shown in FIG. 10.

As in the earlier embodiment the timing of the instant of application of the reverse pressure reversal in relation to the advance of the mould 6 and the subsequent variations of the pressure differential and of the speed of advance may be adapted to suit requirement. In the simplest case the pressure differential remains constant during the advance of the mould 6, and the speed of advance also remains constant, but after the advance of the mould 6 is halted the pressure may be increased to a higher value to ensure that the sheet 1 follows every detail of the mould.

Figure 11:
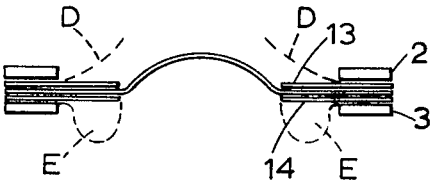
FIG. 11 is a view similar to FIG. 6, showing apparatus with both a bubble plate and a backing plate.
Figure 12:
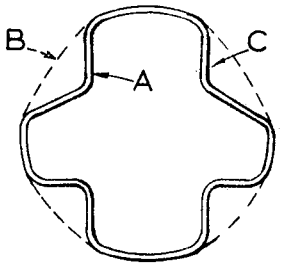
FIG. 12 is a diagrammatic plan view of the items shown in FIG. 11.

Referring now to FIGS. 11 and 12, these illustrate the use of apertured plates, separate from the clamping plates 2 and 3, to ensure correct movement of the sheet as it stretches. Above the clamping plane, i.e. on the same side as the first moulding surface 11, there is an apertured plate 13 that we call the bubble plate, of which the opening is only slightly larger than the maximum dimensions of the required finished body. This ensures that, as the first pressure is applied, the active area, i.e. the area of sheet that stretches to form the bubble, is confined to substantially the outline (in plan view) of the final shape. In the absence of such a plate the bubble would occupy a larger area and after the partial advance of the male mould, immediately prior to application of the reverse pressure, it would hang away from the mould in a 'drape' of large radius of curvature like that shown in broken lines at 'D' in FIG. 11, with the consequence that the application of reversed pressure would induce a high tension in the material and, unless applied very slowly, would result in excessive strain rates and possible rupture.

The bubble plate need not follow closely the profile, in plan view, of the body, as long as it is close at the convex corners. FIG. 12 shows a plan view of a typical body A with re-entrant corners, and the outline of a suitable bubble plate opening is shown at B.

The function of the bubble plate 13 may, as indicated above, be fulfilled by the upper clamping plate 2 but it could also be fulfilled by a portion of the female moulding surface or at least it could be attached to that mould surface instead of to the clamping plates.

Underneath the clamping plane a backing plate 14, on the other hand, does follow closely the outline of the body with a small clearance all the way round. The outline of this backing plate 14 is shown at C in FIG. 12. It will be appreciated that in the absence of such a plate the application of the reversed pressure could result in the sheet being bulged downwards below the clamping plane, as indicated in broken lines at E in FIG. 11. The maximum permissible clearance between the backing plate and the male mould 6 is not critical but generally speaking it should not be above two or three times the thickness of the sheet.

It can be shown that a freely blown bubble will not have a uniform thickness but will be thinner at the crown or peak than at the sides. When the bubble engages the surface 11 or other female mould the friction between the crown of the bubble and that surface will tend to restrict further thinning of that region. However, if a male mould were than simply to advance into the pre-form the regions of the sides of the pre-form nearest to its tip or crown, being thinner already than the regions nearer the root, would be thinned further as a result of stretching by the male mould, and would be liable to rupture. The combination of the steps of pressure reversal and of providing the backing plate 14 ensures that this tendency is counteracted for the following reason. As the male mould advances, a progressively increasing area of the sides of the mould, i.e. the area projecting through the clamping plane, is exposed to the pressure differential, and the sheet material becomes locked against the sides of the male mould 6 progressively from the tip or free end downwards. Thus each incremental annular zone of the sheet, as it frictionally engages the sides of the male mould, is at least partially restrained against further axial extension and the extension is confined to the thicker regions not yet locked against the sides of the mould. By appropriate correlation of the speed of advance and of the application of the reverse pressure, it is possible to obtain an approximately uniform final wall thickness.

After the male mould has been halted, the pressure may be increased for a limited period to a substantially higher value to ensure that the sheet follows every detail of the mould.

Although temperature has not been mentioned above, it will be appreciated that the process described will normally be carried out at an elevated temperature appropriate to the alloy used. In some cases it may be possible to carry out the process at room temperatures.

We Claim:

1. A method of forming a shaped body from a sheet of ductile metal, said method comprising clamping the periphery of sheet in a given plane, applying a differential pressure across said sheet to force said sheet into at least partial contact with a molding surface lying on that side of said sheet which is then at the lower pressure, said sheet being thereby partially shaped, advancing a male mold towards the opposite side of said sheet to project at least partially through said clamping plane, and applying reversed pressure conditions to cause said sheet to come into engagement with said mold and eventually take up the contours of said mold.

2. The method according to claim 1 wherein said molding surface and said sheet are mutually separated before said reversed pressure differential is applied.

3. The method according to claim 1 wherein said molding surface is that of a female mold.

4. The method according to claim 1 wherein said molding surface is a flat surface.

5. The method according to claim 4 wherein said molding surface is assisted by a further molding surface in the form of a guide flange adjacent to the clamped portion of said sheet.

6. The method according to claim 1 wherein said molding surface includes a projecting portion such as to cause the formation of a re-entrant portion on the partially shaped sheet.

7. The method according to claim 1 wherein said molding surface is moved perpendicularly to said clamping plane during the first said application of differential pressure.

8. The method according to claim 7 wherein said molding surface is advanced towards said clamping plane during the first said application of differential pressure.

9. The method according to claim 1 wherein said sheet is supported by an apertured plate on that side of said clamping plane on which said first molding surface lies, the aperture in said plate following closely the outline of at least the convex portions of the profile, in a plane parallel to said clamping plane, of the body to be formed.

10. The method according to claim 1 wherein said sheet is supported closely around the perimeter of said male mold, at least on that side from which said male mold advances, during the advance of said male mold under reversed pressure conditions.

11. The method according to claim 1 wherein said male mold is caused to engage and deform the partially shaped sheet before said reversed pressure differential is applied.

12. The method according to claim 1 wherein said reversed pressure is applied immediately prior to engagement of said sheet by said male mold.

13. The method according to claim 1 wherein said male mold is advanced after engaging said sheet.

* * * * *